US006520665B1

(12) United States Patent
Scandle

(10) Patent No.: US 6,520,665 B1
(45) Date of Patent: Feb. 18, 2003

(54) PORTABLE LAWN AND DECK SHEPHERD LIGHT

(75) Inventor: Edward R. Scandle, 96 Foundryville Rd., Berwick, PA (US) 18603

(73) Assignees: Linda F. Scandle, Berwick, PA (US); Edward R. Scandle, Berwick, PA (US)

( * ) Notice: Subject to any disclaimer, the term of this patent is extended or adjusted under 35 U.S.C. 154(b) by 0 days.

(21) Appl. No.: 09/742,736

(22) Filed: Dec. 21, 2000

Related U.S. Application Data

(60) Provisional application No. 60/171,364, filed on Dec. 22, 1999.

(51) Int. Cl.[7] ..... F21S 13/10

(52) U.S. Cl. ..... 362/431; 362/253; 362/363; 362/414

(58) Field of Search ..... 362/363, 396, 362/410, 414, 431, 234, 253, 122

(56) References Cited

U.S. PATENT DOCUMENTS 1,460,992 A * 7/1923 Vehling ..... 362/122
1,592,247 A * 7/1926 Wise ..... 362/122
4,827,389 A * 5/1989 Crum ..... 362/388
5,295,057 A * 3/1994 Buonsante et al. ..... 362/396
5,337,993 A * 8/1994 Hersman ..... 362/431

* cited by examiner

*Primary Examiner*—Stephen Husar
(74) *Attorney, Agent, or Firm*—Webb Ziesenheim Logsdon Orkin & Hanson, P.C.

(57) ABSTRACT

A portable lighting device, having a light fixture, and having members at its upper end adapted such that items can be supported therefrom. The device has a mounting plate with a prong or the mounting plate defines a hole at the lower end of the fixture to enable the fixture to be pushed into the soil for support, or to enable the device to be secured to a deck or other structure. Alternatively, a mounting plate that can be attached to a portable lamp, the mounting plate having a prong or the mounting plate defines a hole therethrough such that the lamp can be pushed into the soil for support, or enable the device to be secured to a deck or other structure.

11 Claims, 6 Drawing Sheets

PORTABLE LAWN AND DECK SHEPHERD LIGHT

CROSS-REFERENCE TO RELATED APPLICATION

This application claims the benefits of U.S. Provisional Patent Application bearing Ser. No. 60/171,364 filed Dec. 22, 1999.

BACKGROUND OF THE INVENTION

1. Field of the Invention

This invention relates to portable lighting devices.

2. Description of the Prior Art

Portable lighting devices are well-known in the art. Lamps with bases, available in a wide variety of configurations, are common household items. However, a need exists for a light that combines portability, offers options in support, and has a distinctive appearance. Additionally, a need exists for a distinctive lighting fixture that is able to support decorations, additional lighting, or other items contributing to a decorative scheme.

SUMMARY OF THE INVENTION

The present invention is a light fixture positioned on a tube to which hooks or other ornamentation and pipe supports are mounted. An electric cord passes through the tube to supply power to the light fixture. A light fixture mounting plate can be used to secure the light fixture to the tube. A globe can be secured to the light fixture to protect the fixture and provide for a pleasant appearance. A prong extending from a mounting plate is removably attached to the base of the tube. The prong is adapted to be pushed into soil to support the lamp. Alternatively, a mounting plate defining a hole adapted such that a fastener can secure the lamp to a deck or other structure is removably attached to the base of the tube. Using a coupler, the two different bases can be used interchangeably with the light. A water-resistant power cord extending from the base of the lamp and a pier mount fixture allows power to be supplied and allows the lamp to be used outdoors.

The present invention is also a mounting plate that can be removably attached to a light. The mounting plate is defined as at least one of a prong, the prong adapted to co-act with soil to support the light, or a hole therethrough, the hole adapted to receive a fastener to secure the light to a deck or other structure.

A system of lighting wherein the electric cords of a plurality of the new lights being connected together in parallel electrical communication with a source of electrical power is also disclosed.

DETAILED DESCRIPTION OF THE PREFERRED EMBODIMENTS

Figure 1:
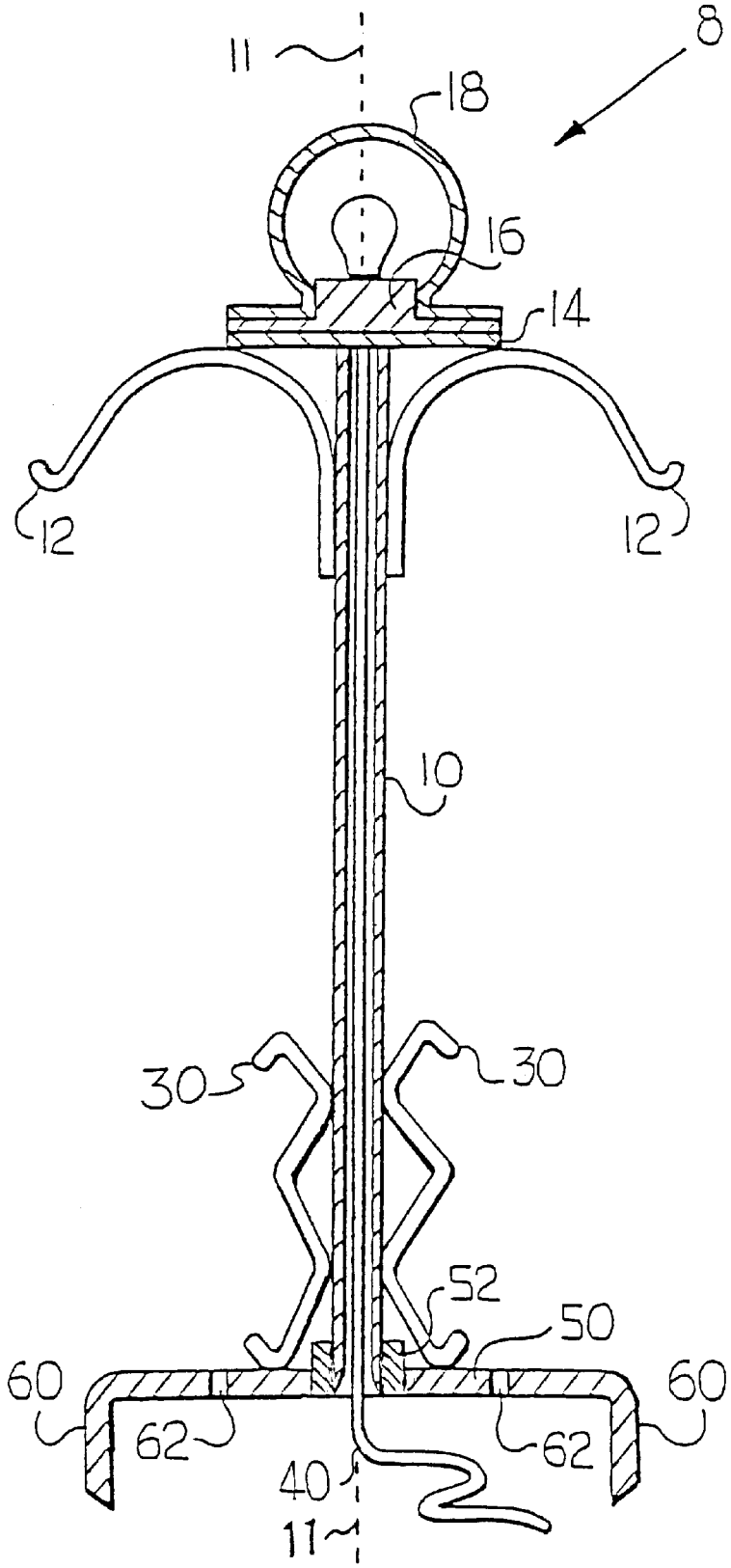
FIG. 1 is a side elevation view, partially in section, of a portable lawn and deck shepherd light made in accordance with the present invention.

As shown in FIG. 1, a portable lawn and deck shepherd light 8 of the present invention includes, in a single unit, a number of distinctive and festive elements. Hooks incorporated into the lamp are evocative of a shepherd's crook and optionally can be functional in that the hooks provide support for items such as garlands, streamers, banners, strings of lights, or hanging baskets for plants. Additionally, the hooks provide protection for fragile elements of the light during transport and use. Pipe supports near the base of either lamp contribute to the structural integrity and appearance of the lamps. The base of the light can be configured either with prongs adapted to be pushed into soil to support the light, or a mounting plate can be affixed to secure the light to a deck or other structure.

The light 8 contains a tube 10 having a longitudinal axis 11. A plurality of hooks 12 is affixed to an upper end of tube 10. Hooks 12, in conjunction with tube 10, emulate the appearance of a shepherd's crook. A light fixture mounting plate 14 is positioned at the upper end of tube 10. A light fixture 16 is positioned on light fixture mounting plate 14. Optionally, a globe 18 is positioned on the upper end of tube 10. Globe 18 and light fixture mounting plate 14 enclose light fixture 16. A plurality of decorative pipe supports 30 is positioned at a lower end of tube 10. An electric cord 40 extends from light fixture 16 through tube 10 to supply power to light fixture 16. A base mounting plate 50 is positioned at the lower end of tube 10. A coupler 52 secures tube 10 to base mounting plate 50. Coupler 52 can include internal and external threads to be threadedly secured to respective threaded surfaces of a lower end of the tube 10 and the base mounting plate 50.

Figure 2:
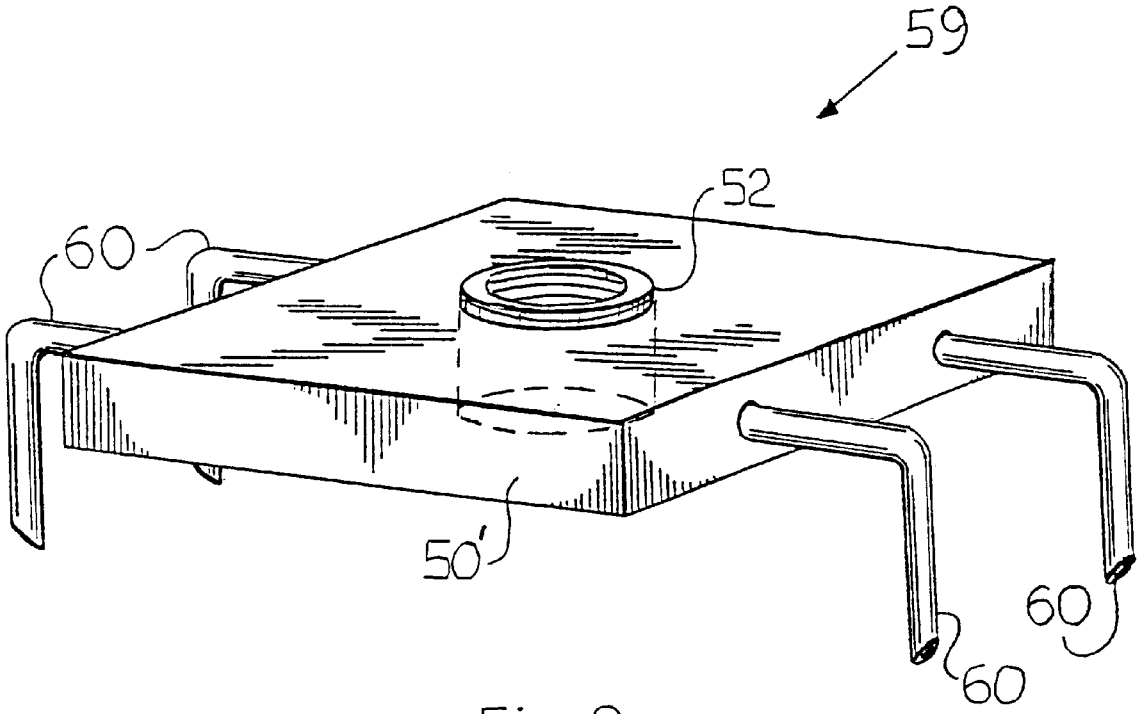
FIG. 2 is a perspective view of a pronged stand made in accordance with the present invention.
Figure 3:
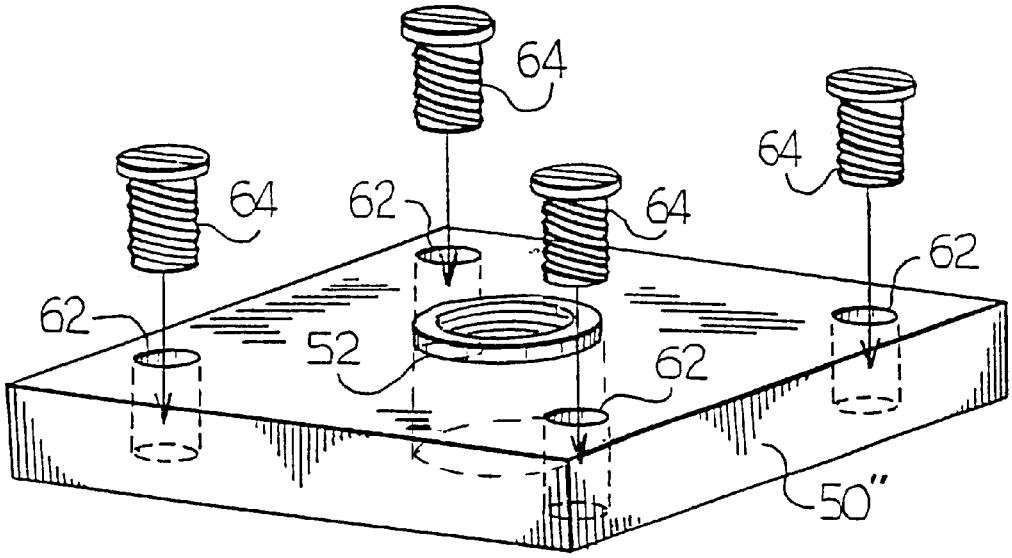
FIG. 3 is a perspective view of a mounting plate made in accordance with the present invention.
Figure 7:
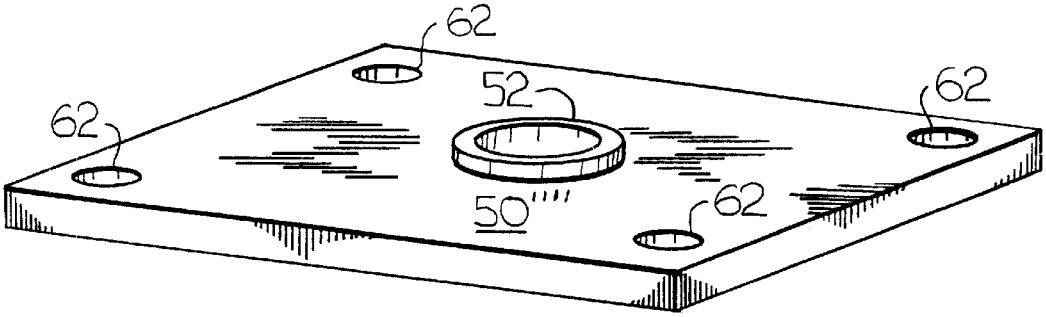
FIG. 7 is a perspective view of an alternative embodiment of a mounting plate made in accordance with the present invention.
Figure 10:
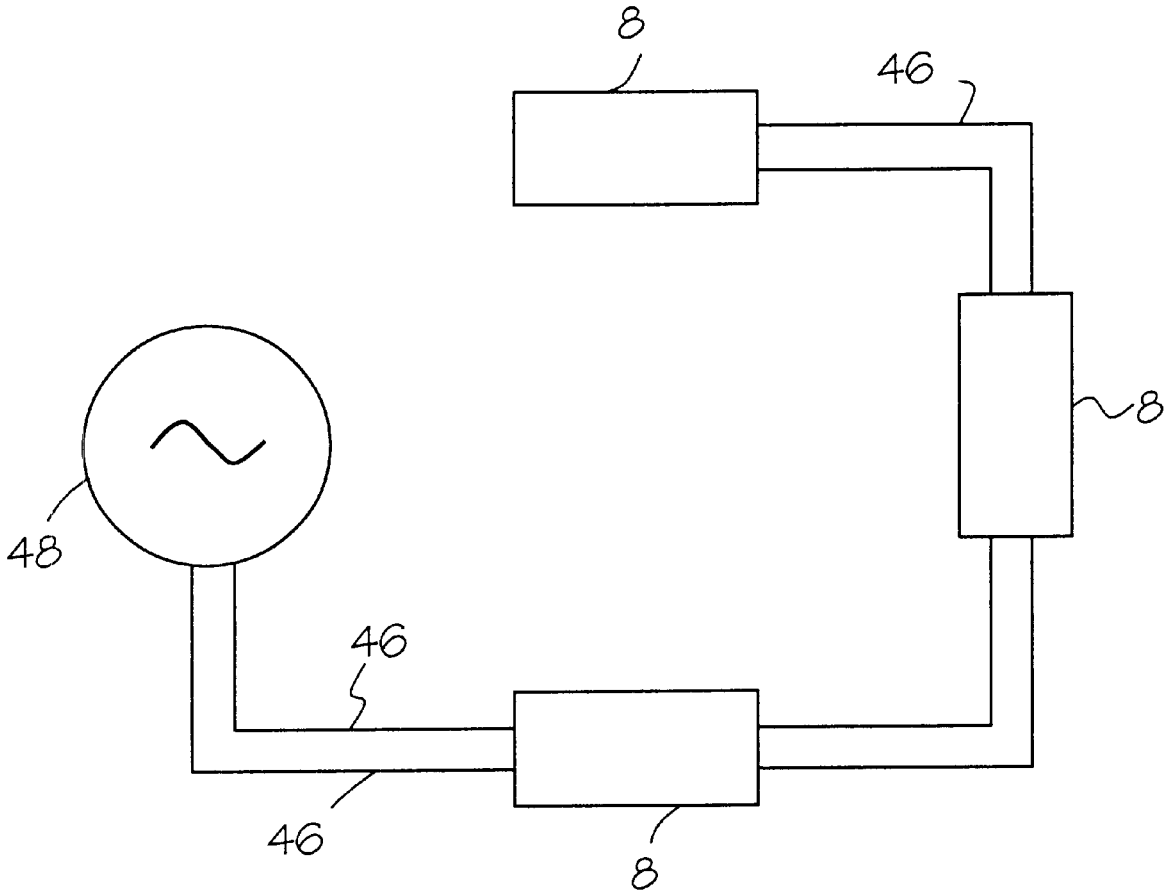
FIG. 10 is a schematic view of lights electrically connected in parallel made in accordance with the present invention.

Referring to FIG. 2, a pronged stand 59 having a plurality of prongs 60 extends from base mounting plate 50' in lieu of base mounting plate 50, as shown in FIG. 1. The prongs 60 are adapted to be pushed into soil to support the light 8. The plurality of prongs 60 are shown set into base mounting plate 50'. However, the prongs may be secured to base mounting plate 50' such as by welding the plurality of prongs 60 to the side or bottom of base mounting plate 50'. Moreover, the portion of the plurality of prongs 60 in the plane of the base mounting plate 50' may be bent away from base mounting plate 50' such that the footprint of the plurality of prongs 60 is increased. Alternatively, as shown in FIGS. 3 and 7, pronged stand 59 may be omitted and base mounting plate 50" and 50"", respectively, may be furnished with mounting holes 62. Base mounting plate 50" of FIG. 3 is similar to base mounting plate 50, except it only has the mounting holes 62. Screws 64, or other appropriate fasteners, when fitted through mounting holes 62, may be used for securing the light to a deck or other structure. Coupler 52 is internally threaded, as shown in FIGS. 2 and 3, to allow the interchange of configurations of base mounting plate 50' or 50". Coupler 52 is shown having external threads such that can be removably secured to either base mounting plate 50' or 50". Alternatively, coupler 52 can be fixedly secured to base mounting plate 50' or 50" such as by welding. FIG. 10 shows a schematic of a plurality of lights 8, electrically connected in parallel fashion, that may be provided to illuminate a yard or other large area. Each light 8 is connected to a second electric cord 46 which is, in turn, in electrical communication with a power source 48.

In a preferred embodiment of the light 8, globe 18 is fabricated from transparent or translucent plastic. Light fixture 16 is preferably a plastic pier mount. Light fixture 16 is preferably configured to engage globe 18 so that light fixture 16 and globe 18 together define a space within which a light bulb is enclosed. Examples of engagement configurations include matching threads on light fixture 16 and globe 18, and corresponding mounting holes on light fixture 16 and globe 18 accommodating screws, bolts or other fasteners. Hooks 12 are constructed of bar stock with a round cross section. Pipe supports 30 are constructed of square cross-section bar stock. Prongs 60 are constructed of round cross-section bar stock. Base mounting plate 50 and 50' are constructed of one quarter inch steel plates measuring approximately 4×6 inches.

Figure 4:
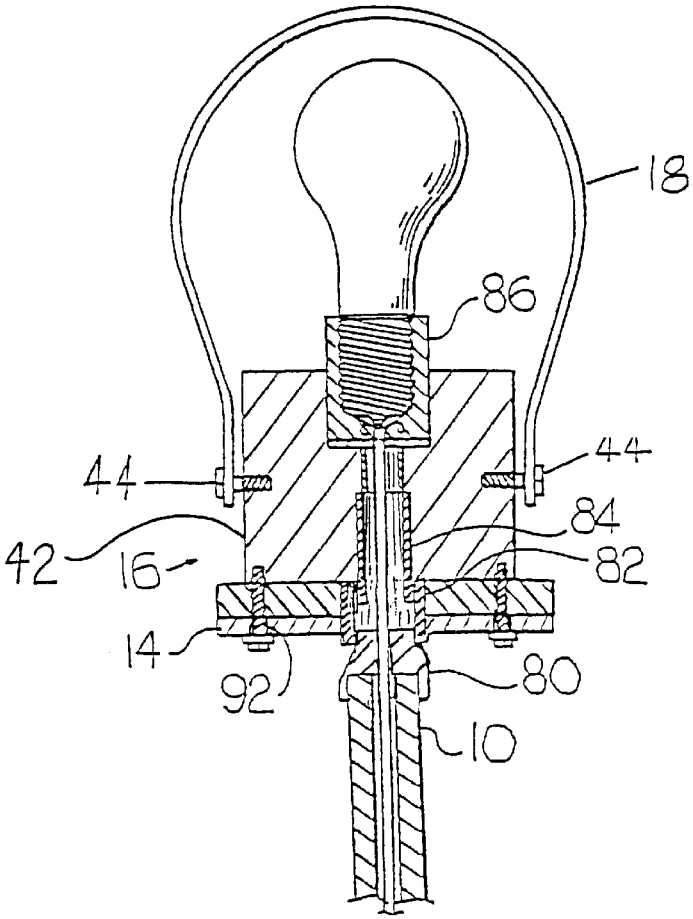
FIG. 4 is a side elevation view, partially in section, of an alternate embodiment of a portable lawn and deck shepherd light made in accordance with the present invention.
Figure 5:
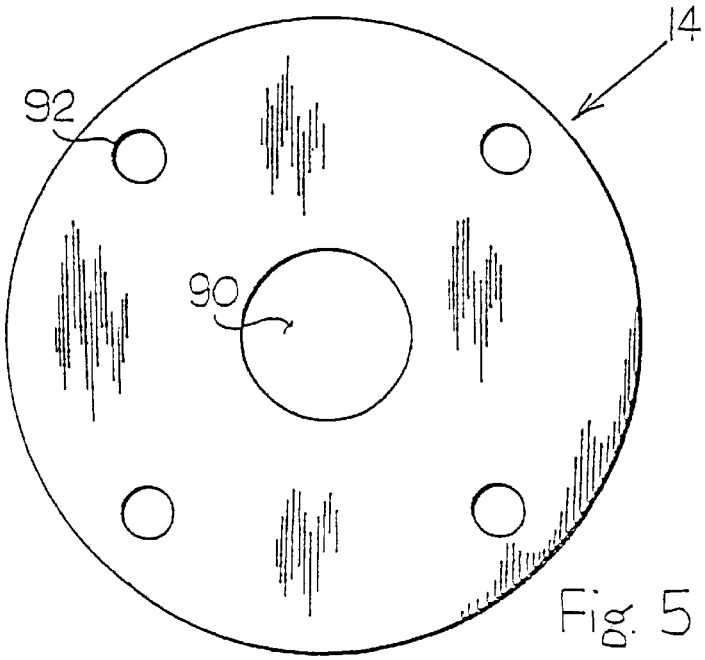
FIG. 5 is a top view of a light fixture mounting plate made in accordance with the present invention.

In another embodiment as shown in FIG. 4, a bell reducer 80 is engaged to the upper end of tube 10 of the light 8. Bell reducer 80 is threadedly engaged to tube 10. The light fixture mounting plate 14 is supported between bell reducer 80 and a reducer bushing 82 that are threaded together and pass through light fixture mounting plate 14. A light fixture 16 is comprised of two members, a mount 42 and an adapter kit 86. Preferably, the mount 42 is a plastic pier mount and the adapter kit 86 is a porcelain socket. The purpose of the mounting plate 14 is to support the mount 42 to which globe 18 is attached using self tapping screws 44. An all thread tube 84 is threadedly engaged to reducer bushing 82. A porcelain socket adapter kit 86, housed in light fixture 16, is engaged to all thread tube 84. Globe 18 is engaged to light fixture 16. The arrangement of bell reducer 80, reducer bushing 82, all thread tube 84 and adapter kit 86, in conjunction with the mount 42 and the mounting plate 14, creates a water- and weather-resistant light that minimizes the likelihood of electric shock. As shown in FIG. 5 in this embodiment, light fixture mounting plate 14 contains a hole 90 to allow the connection of bell reducer 80 to reducer bushing 82, and at least one hole 92 to allow the attachment of light fixture 16.

Figure 6:
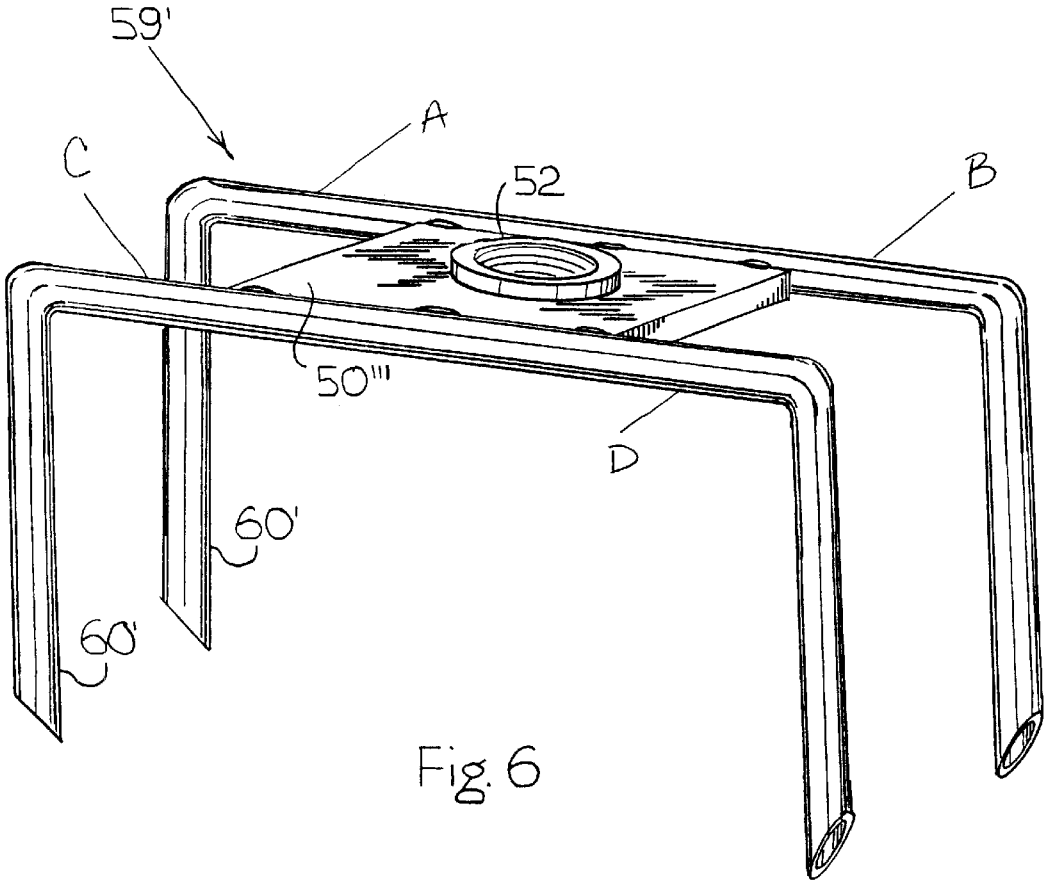
FIG. 6 is a perspective view of an alternative embodiment of a pronged stand made in accordance with the present invention.

FIG. 6 shows a pronged stand 59' having a plurality of prongs 60' welded or attached by other suitable means to base mounting plate 50'''. A pair of prongs 60' may be fashioned from opposite ends of bar stock or other suitable material. The prongs 60' are adapted to be pushed into soil to support the light 8. Coupler 52 is welded or otherwise permanently affixed to base mounting plate 50''' and has internal threads. Pronged stand 59' can be used in lieu of pronged stand 59, shown in FIG. 2. The portion of the plurality of prongs 60' that lie within the plane of base mounting plate 50'''' can be bent away from base mounting plate 50'''' such that the overall footprint of the plurality of prongs 60' is increased to provide stability when prong stand 59' is attached to the balance of a deck shepherd lamp. The portion of the plurality of of prongs 60' that lie within the plane of base mounting plate 50''' are identified in FIG. 6 as A, B, C, and D.

FIG. 7 shows a base mounting plate 50'''' that is similar to base mounting plate 50", except that coupler 52 is welded or otherwise permanently affixed to base mounting plate 50''''. Mounting holes 62 facilitate the securing of the light 8 to a deck or other structure.

Figure 9:
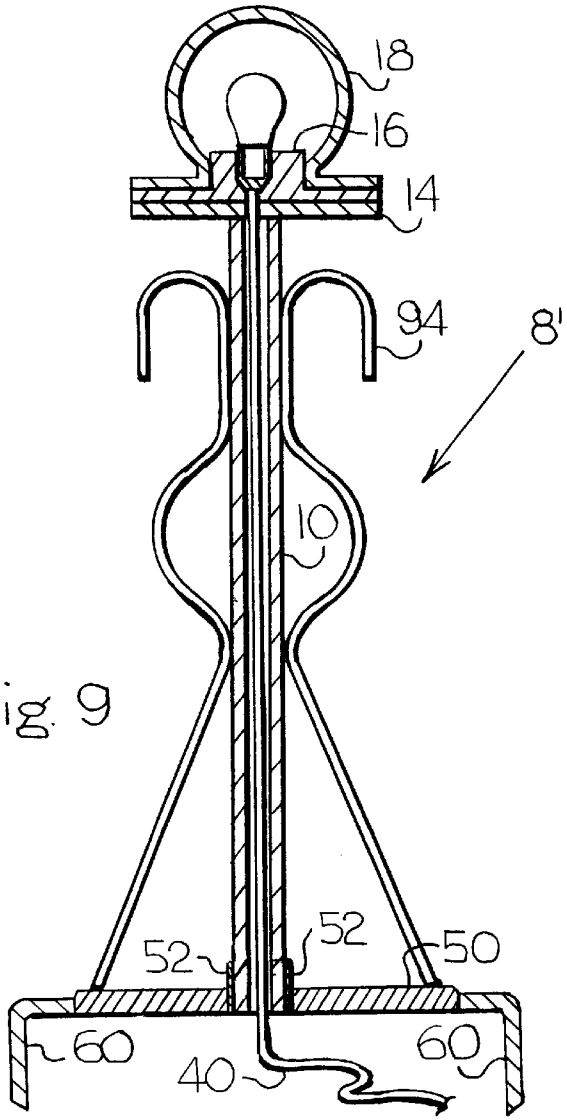
FIG. 9 is a cross-sectional view along lines IX—IX of the portable lawn and deck shepherd light as shown in FIG. 8.
Figure 8:
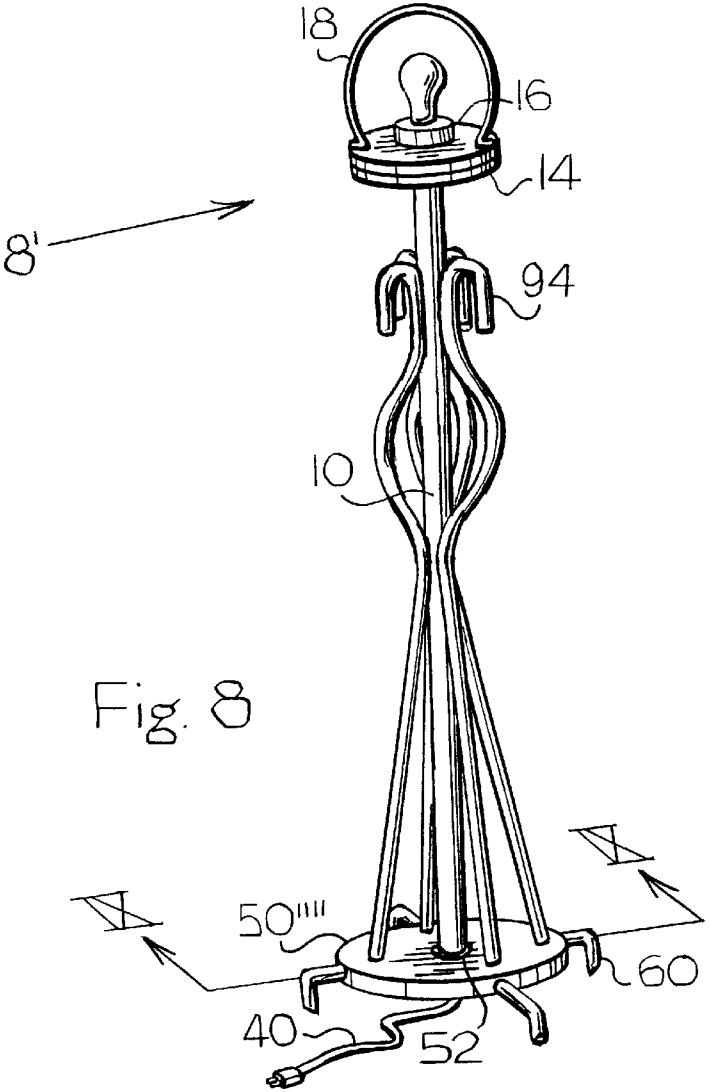
FIG. 8 is a perspective view of a second alternate embodiment of a portable lawn and deck shepherd light made in accordance with the present invention.

An alternate portable lawn and deck shepherd light 8' of the present invention is shown in FIGS. 8 and 9. The deck shepherd light 8' is similar to the deck shepherd light 8 and like reference numerals are used for like elements. A plurality of hook elements 94 is provided and attached to the tube 10 so that they are incorporated into the lamp to provide ornamentation and optionally can provide support for items such as garlands, streamers, banners, strings of lights, or the like. Hook elements 94 are constructed of bar stock of a round or rectangular cross section. Additionally, the hook elements 94 provide protection for fragile elements of the light 8' during transport. Again, the base of the light 8' can be configured either with prongs 60 adapted to be pushed into soil to support the light 8', or a mounting plate 50'''' can be affixed to secure the light 8' to a deck or other structure. Alternate portable lawn and deck shepherd light 8' is shown having a round mounting plate 50'''' with prong 60 set into the plate. Mounting plate 50'''' can also be of square or rectangular shape and the prongs 60 can be affixed by welding them to the sides or bottom of mounting plate 50'''' as described above. In the preferred embodiment, portability of the alternate portable lawn and deck shepherd light 8' is increased by manufacturing the light so that the overall height is approximately 43" thereby decreasing the weight of alternative portable lawn and deck shepherd 8'. Hook elements 94 or hooks 12 may be eliminated in the 43" model or the light 8 shown in FIG. 1.

The plurality of hook elements 94 is affixed to an upper end of tube 10. A light fixture mounting plate 14 is positioned at the upper end of tube 10. Hook elements 94 may be configured to provide support at the lower end of tube 10. A base mounting plate 50 is positioned at the lower end of tube 10. A coupler 52 secures tube 10 to base mounting plate 50. Coupler 52 can include internal and external threads to be threadedly secured to respective threaded surfaces of a lower end of the tube 10 and the base mounting plate 50. Prongs 60 are shown fixedly attached, such as by welding, to base mounting plate 50. An electric cord 40 is shown passing through the coupler 52, tube 10 and light fixture mounting plate 14 to light fixture 16. Hook elements 94 are adapted to be larger than globe 18, such that hook elements 94 can protect globe 18 and light fixture 16 from damage during transport, or should portable lawn and deck shepherd light 8' be knocked over during use. As shown in FIG. 10, a plurality of lights 8' can be substituted for lights 8 and be electrically connected in parallel fashion, providing illumination for larger areas.

In a still further embodiment, a light, not shown, is made without hooks 12 or hook elements 94 and the length of the tube 10 is shortened. The light otherwise comprises all of the elements discussed above. A plurality of these shortened tube lights without hooks or hook elements can be substituted for light 8, as shown in FIG. 10, and be electrically connected in parallel fashion, providing illumination for larger areas.

Preferably, the portable lawn and deck shepherd light 8 is provided in a kit form, whereby the tube 10 is removably secured to the pronged stand 59 while a mounting base plate 50" is provided with appropriate screws 64 in a package. Should the end user wish to change from the pronged stand 59 to the base plate 50", the user need only to threadably remove the tube 10 from the pronged stand 59 and then pull the end of the electric cord 40 through the coupler 52. Then the end of the electric cord 40 is passed through the coupler 52 of the base plate 50" and the tube 10 is threadably mounted thereto. The base plate 50" then can be secured to a structure through screws 64.

Having described the currently preferred embodiment of the present invention, it is to be understood that the invention may be otherwise embodied within the scope of the appended claims.

I claim:

1. A light, comprising:

a tube;

a light fixture attached to the tube;

hooks affixed to the tube configured to support items therefrom;

an electric cord, in electrical communication with the light fixture; and a globe co-acting with the light fixture and defining a closed cavity to enclose a light bulb positioned in electrical communication with the light fixture, wherein the hooks affixed to the tube configured to support items therefrom extend radially from the tube a greater distance than the lamp globe.

2. The light of claim 1, further comprising a light fixture mounting plate that secures the light fixture to the tube.

3. The light of claim 1, further comprising a plurality of decorative supports attached to the lower end of the tube.

4. The light of claim 1, further comprising:

a base mounting plate, removably attached to the lower end of the tube; and a coupler, attaching the tube to the base mounting plate, the electric cord passing through the base mounting plate and the coupler.

5. The light of claim 4, further comprising a plurality of prongs extending from the base mounting plate, wherein the tube extends along a longitudinal axis and the prongs are offset from the longitudinal axis.

6. The light of claim 4, wherein the base mounting plate defines a mounting hole therethrough adapted to receive a fastener to secure the light to a structure.

7. The light of claim 1, further comprising:

a base mounting plate, removably attached to the lower end of the tube; and a coupler, attaching the tube to the base mounting plate, wherein the base mounting plate defines at least one of a prong and a mounting hole therethrough, the mounting hole adapted to receive a fastener to secure the light to a structure, the electric cord passing through the base mounting plate and the coupler.

8. A light, comprising:

a tube, having an upper end and a lower end;

a light fixture attached to the interior or exterior of the tube using a light fixture mounting plate;

a plurality of hooks secured to the tube and configured to support items therefrom;

a plurality of decorative supports attached to the lower end of the tube;

a globe co-acting with the light fixture and defining a closed cavity to enclose a light bulb positioned in electrical communication with the light fixture;

an electric cord, in electrical communication with the light fixture; and a base mounting plate removably attached to the lower end of the tube, wherein the base mounting plate defines at least one of a prong extending therefrom or a mounting hole therethrough, the mounting hole adapted to receive a fastener to secure the light to a structure, wherein the hooks extend radially from the tube a greater distance than the globe.

9. The light of claim 8, wherein the light fixture further comprises a pier mount affixed to the light fixture mounting plate.

10. A light, comprising:

a tube extending along a longitudinal axis;

a light fixture attached to the tube;

an electric cord, in electrical communication with the light fixture;

a base mounting plate attached to the lower end of the tube;

a plurality of prongs extending from the base mounting plate wherein the base mounting plate is removably attached to said tube; and wherein the light fixture further comprises a water resistant pier mount attached to the tube.

11. A lighting system comprising a plurality of lights, wherein each light comprises:

a tube;

a light fixture attached to the tube using a light fixture mounting plate;

a hook secured to the tube and configured to support items therefrom;

a decorative support attached to the lower end of the tube;

a globe co-acting with the light fixture and defining a closed cavity to enclose a light bulb positioned in electrical communication with the light fixture;

an electric cord, in electrical communication with the light fixture; and a base mounting plate removably attached to the lower end of the tube, wherein the base mounting plate defines at least one of a prong extending therefrom or a mounting hole therethrough, the mounting hole adapted to receive a fastener to secure the light to a structure, wherein the electric cords of each light being connected together in parallel electrical communication with a source of electrical power.

* * * * *

UNITED STATES PATENT AND TRADEMARK OFFICE

CERTIFICATE OF CORRECTION

PATENT NO. : 6,520,665 B1 
DATED : February 18, 2003
INVENTOR(S) : Edward R. Scandle It is certified that error appears in the above-identified patent and that said Letters Patent is hereby corrected as shown below:

Column 3,
Line 61, “50”” can be” should read -- 50’” can be --.
Line 62, “50”” such that” should read -- 50’” such that --.

Signed and Sealed this

First Day of July, 2003

JAMES E. ROGAN
*Director of the United States Patent and Trademark Office*